US006615895B2

(12) United States Patent
Marocco

(10) Patent No.: US 6,615,895 B2
(45) Date of Patent: Sep. 9, 2003

(54) BLIND WITH REINFORCED HEAD RAIL

(75) Inventor: Norbert Marocco, Woodbridge (CA)

(73) Assignee: Shade-O-Matic Limited, Toronto (CA)

( * ) Notice: Subject to any disclaimer, the term of this patent is extended or adjusted under 35 U.S.C. 154(b) by 0 days.

(21) Appl. No.: 10/054,140

(22) Filed: Jan. 22, 2002

(65) Prior Publication Data

US 2003/0136525 A1 Jul. 24, 2003

(51) Int. Cl.[7] ..... E06B 9/38
(52) U.S. Cl. ..... 160/173 R; 160/178.1 R
(58) Field of Search ..... 160/173 R, 173 V, 160/166.1 R, 168.1 R, 168.1 V, 172 R, 178.1 R, 178.1 V

(56) References Cited

U.S. PATENT DOCUMENTS 2,651,358 A * 9/1953 Lorentzen ..... 160/178.1 R
2,673,608 A * 3/1954 Nelson ..... 160/178.1 R
2,787,322 A * 4/1957 Jacobson et al. ..... 160/173 R
4,441,540 A * 4/1984 Tsuhako ..... 160/178.1 R X
4,518,025 A * 5/1985 Judkins ..... 160/168.1 R
5,348,068 A * 9/1994 Elsenheimer et al. . 160/176.1 R
5,520,235 A * 5/1996 Coleman ..... 160/178.1 R X
6,164,362 A * 12/2000 Yang ..... 160/173 R X
6,263,945 B1 * 7/2001 Nien ..... 160/173 R

* cited by examiner

*Primary Examiner*—David Purol
(74) *Attorney, Agent, or Firm*—Ohlandt, Greeley, Ruggievo & Perle, L.L.P.

(57) ABSTRACT

An extruded plastic head rail for a blind of the type having blind elements suspended from such head rail, in which the head rail is reinforced to prevent sagging of the head rail under the load of the blind elements, and in which the head rail is suitable for trimming to length by a point of sale trim cutting apparatus, the head rail having a head rail extrusion extruded from plastic material and, a reinforcement member in the head rail, the reinforcement member extending along at least a median portion of length of the head rail, the reinforcement member supporting the head rail and the blind elements, to prevent bending of the head rail under the load of the blind elements.

20 Claims, 7 Drawing Sheets

BLIND WITH REINFORCED HEAD RAIL

FIELD OF THE INVENTION

The invention relates to blinds of the kind having a head rail, and a plurality of blind slats suspended from the head rail, and in particular to such a blind in which the head rail is formed of plastics material, such as extruded polyvinyl chloride material, and is reinforced along its interior, with reinforcement members, preferably, though not exclusively, with metal reinforcements.

BACKGROUND OF THE INVENTION

Blinds having a head rail and blind slats suspended from the head rail are well known. Such blinds include "venetian" blinds in which the slats run from side to side, horizontally, and also vertical blinds in which the slats hang vertically down from trollies carried in the head rail.

For many years such head rails have been made of metal. Usually they have been formed in the shape of a rectangular U-shaped channel, with the blind operating and control mechanism located in the channel.

In recent years however customers have been seeking a more economical form of blind. Head rails for less expensive blinds are now commonly made of extruded plastics material, such as polyvinyl chloride materials. Such materials have their advantages such as low cost and freedom from maintenance and the like. However customers are always seeking for new and different visual effects in blinds. In one case it has become the practice to make the blind slats themselves of extruded plastic materials. These are both less expensive than metal blind slats, and also provide a more solid look than conventional thin metallic blind slats.

However the use of such thicker plastic blind slats carries with it the penalty of greater weight. In fact for a given size of window the use of thicker plastic slats, can increase the weight to the point where they will impose bending stresses on the extruded plastic head rail, and it will bow downwardly in the centre.

This is both unsightly, and may also cause malfunction of the blind control mechanism located within the head rail.

The problem could be overcome by using a conventional metallic head rail, but this would increase the cost, and might also affect the appearance of the blind.

Another factor in the marketing of such blinds is that is becoming the custom to market these blinds through department stores. Blinds are supplied to the store in standard widths. A customer will measure the actual window or door opening in which he wishes to erect a blind. He will then place his order in the store. The sales clerk will then select a blind having a width greater than that required by the customer.

He will then trim the ends of the blind head rail and the blind slats (and the bottom rail if provided) so as to fit the customer's requirement.

Various machines are available for trimming blinds. Some use cutting blades. Others use actual profiled cutting dies, especially for cutting metallic head rails.

Examples of such in store point of sale blind trimming machines can be seen in U.S. Pat. No. 5,806,394, 6,196,099, 6,178,857, 6,089,134, all of which are owned by Shade-O-Matic Llimited, also the owner of the present application.

However, where the blinds have a plastic head rail, and extruded plastic slats, and a bottom rail in some cases, it is preferable to cut them with a saw. The plastic is softer and at the same time thicker than the metal used for conventional head rails. Thus in the case of a blind having a plastic head rail, and plastic blind slats, the length of the cutting stroke required to cut a given number of plastic blind slats is increased compared with cutting the same number of metal blind slats. Cutting such plastic slats with a knife edge requires considerable effort. It also tends to damage the plastic at the ends of the slats. Because the stroke required to cut the stack of thicker plastic blind slats is much longer than the stroke required to cut thin metal blinds slats, then either the manual effort required to make the cut must increase, or the leverage available in the cutting machine must be increased. Neither is desirable or practical. It is in fact found that the use of a saw, typically a rotary saw disc will provide a quick clean cut through the relatively softer plastic blind slats, and also the plastic head rail, with a minimum of physical effort.

This also has the added advantage that the head rail, usually a U-shaped channel, can be cut cleanly with a saw, without the need for supporting it in a special die. Such rotary saw cut down equipment is now becoming widely available in retail stores, rendering it possible to such stores to meet public demand for low cost blinds, trimmed to size on demand, in the store.

However, if the plastic head rail is not capable of supporting the weight of the blind slats then it should preferably be given some kind of reinforcement such that it will be effective to prevent sagging under the weight of the plastic blind slats.

However, the reinforcement must be such that it does not prevent the head rail from being cut down or trimmed in the in store trimming apparatus, of which the saw cutting equipment now available is one example, in the retail stores.

BRIEF SUMMARY OF THE INVENTION

An extruded plastic head rail for a blind of the type having blind elements suspended from such head rail, in which the head rail is reinforced to prevent sagging of the head rail under the load of the blind elements, and in which the head rail is suitable for trimming to length by point of sale trim cutting apparatus, the head rail having a head rail extrusion extruded from plastic material and, a reinforcement member attached to the head rail, the reinforcement member extending along at least a median portion of length of the head rail, the reinforcement member supporting the head rail and the blind elements, to prevent bending of the head rail under the load of the blind elements.

The invention further seeks to provide an extruded plastic head rail for a blind wherein said head rail defines a front side wall and a rear side wall and a bottom wall.

The invention further seeks to provide an extruded plastic head rail for a blind wherein said reinforcement member comprises a three sided channel of reinforcement material.

The invention further seeks to provide an extruded plastic head rail for a blind wherein said reinforcement material is metallic.

The invention further seeks to provide an extruded plastic head rail for a blind wherein said reinforcement material is rigid strip of plastic material.

The invention further seeks to provide an extruded plastic head rail for a blind wherein said reinforcement member is a generally three sided channel fitting within said head rail.

The invention further seeks to provide an extruded plastic head rail for a blind wherein said reinforcement member comprises a planar strip of metallic material The invention further seeks to provide an extruded plastic head rail for a blind wherein the head rail has at least a front wall and a bottom wall, and reinforcement attached thereto.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As mentioned above the invention relates to blinds in which the head rail supports blind slats, and in which the head rail is made of plastics material and is reinforced to carry the weight of the blind slats. Typically the blinds are "Venetian" blinds with a plurality of horizontal blind slats. However the invention does not exclude to possibility of its use with vertical blinds, in which the blind slats hang vertically down from the head rail.

Figure 1:
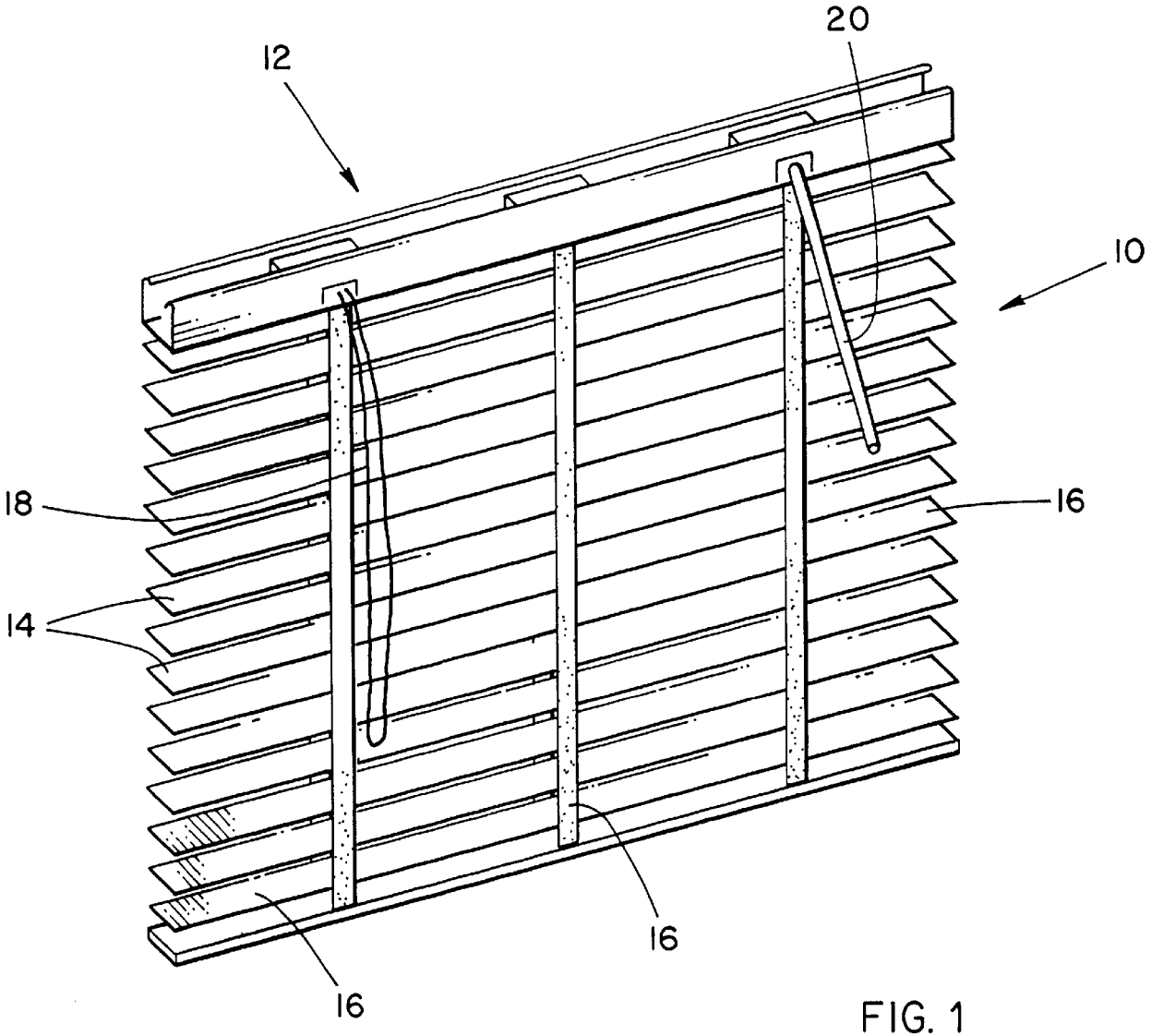
FIG. 1 is a general perspective of a typical venetian blind, for the purposes of illustrating the invention.

Thus, purely for purpose of explanation and without limitation FIG. 1 illustrates a typical "venetian" blind 10. It has a head rail 12, and blind elements, in this case slats 14, attached on ladder tapes 16. A tilt control rod 18, and raise cords 20 provide means by which the blind slats can be tilted open or closed, or raised or lowered, in known manner. In many cases it may also have a bottom rail, also of extruded plastic material. The blind controls 18 and 20 are all mounted in the head rail. The head rail 12 in this embodiment, is shown in the form a three sided U-shaped channel, with the open side facing upwardly. As has been explained there is a demand for more economical blinds, in which the blind elements or slats are made of extruded plastic and are relatively thick and heavy. In these lower cost blinds it is desirable to make both the head rail and the blind slats from extruded plastic. This renders the blind easier to trim to length at a point of sale using an in store trim cutting apparatus However it is found that where the blind slats are heavy, because for example they are made of relatively thick extruded solid plastic material, or even of wood in some cases, the plastic head rail will bend and sag in the middle. This will be unsightly and cause malfunction of the blind controls located in the head rail.

While blind slats are illustrated it will be understood that the invention is not solely limited to blinds having blind slats. The term blind elements as used herein is intended to include both blind slats and other forms of blind designs, whether having slats, fabric, or any other type of window covering.

Accordingly the invention makes provision for the reinforcement of the plastic head rail so as to give it increased strength and enable it to resist bending stresses.

Figure 2:
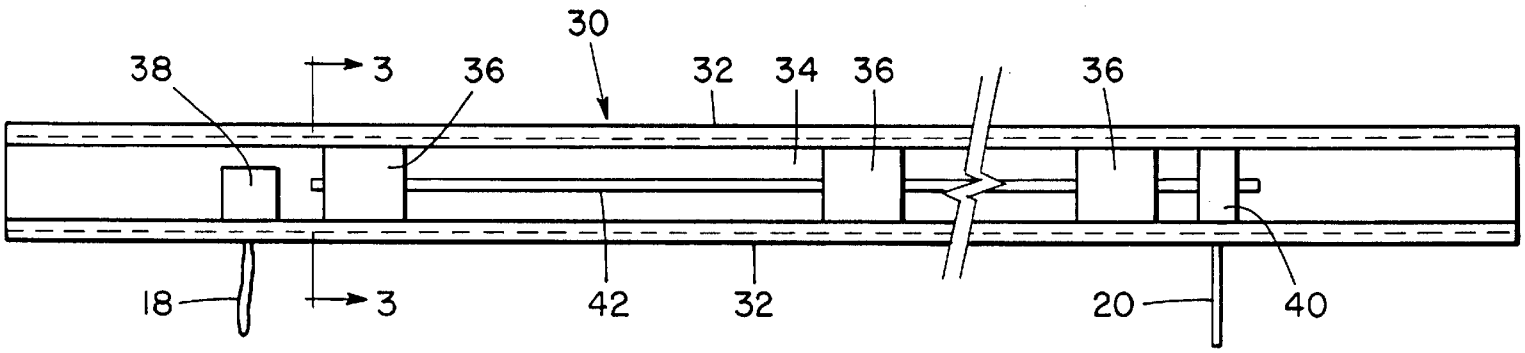
FIG. 2 is a top plan view of a head rail illustrating one embodiment of the invention.
Figure 3:
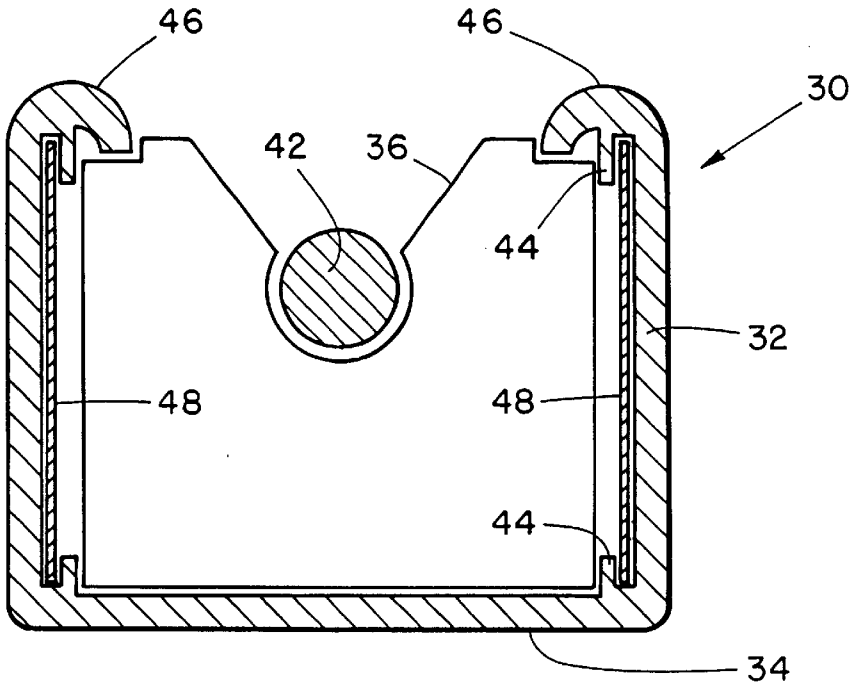
FIG. 3 is a section along line 3—3 of FIG. 2.

One embodiment of the invention is illustrated in FIGS. 2, and 3.

A head rail 30 is illustrated, formed of plastic material, such as polyvinyl chloride extruded, in this embodiment, in a channel shape of a head rail. It defines side walls 32-32, and a web 34. The upper side is open upwardly. Blind controls, consisting of tape drums 36, and a raise cord lock 38 and a tilt control 40 are located in head rail 30. A transmission rod 42 extends through the tilt control 40 and drums 36.

All of this is well known in the art and requires no description.

As shown in FIG. 3 the head rail is formed on its interior with upper and lower ridges 44, which extend parallel to side walls 32 but are spaced inwardly.

Upper arcuate ribs 46 are formed along the upper edges of side walls 32, and face inwardly partially closing the open upper side of the channel of head rail 30.

In order to reinforce the head rail, in this embodiment, two planar reinforcement strips 48 are secured within the head rail 30. Strips 48 are secured in place by sliding between ridges 44 and side wails 32 (FIG. 3). The reinforcement strips 48 may typically be formed of a suitable metal. However the invention does not exclude the use of non-metallic reinforcement strips, such as might be made of some more rigid form of plastic material, for example fibre reinforced resin materials or the like.

Where the reinforcement is of a material, or a metal, which is suitable for in store trim cutting for example by saw cutting trim apparatus, for example, aluminum, then the reinforcement strips can extend from end to end of the head rail. When trimming the head rail down to size, at the point of sale, in the retail store, the sales clerk will simply place one end of the head rail, and the blind slats and the bottom rail (if provided) in a saw cut down machine (not shown) and make a cut, and then reverse the blind and make a similar trim cut at the other end of the components, using the saw for example. Such a saw will easily cut through both the plastic head rail and the softer metal reinforcement, as well as through the bind slats and bottom rail.

Figure 4:
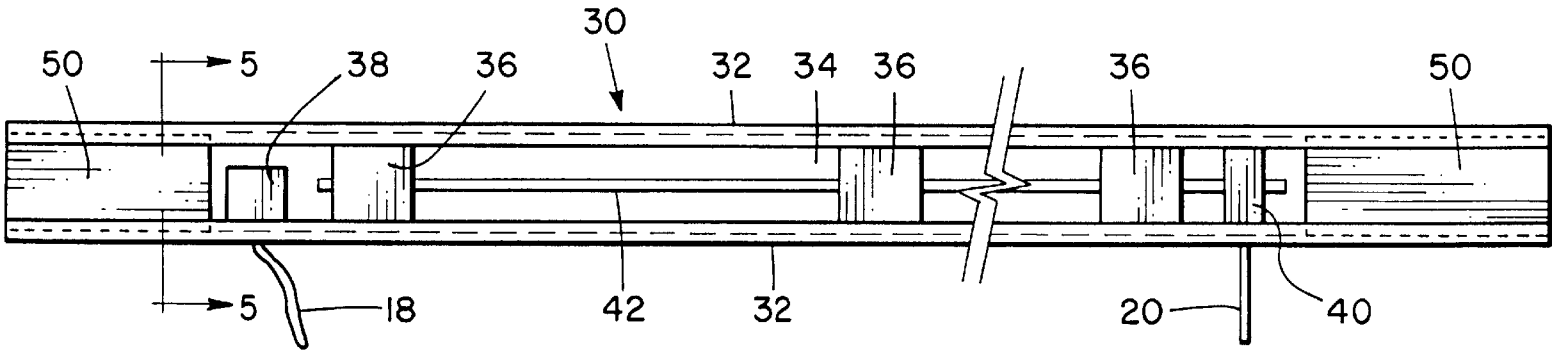
FIG. 4 is a top plan view of a head rail illustrating another embodiment of the invention.

However, in some cases the metallic strip or strips will be of harder metal such as steel. In these cases also, it is necessary to permit a sales clerk to trim the ends of the head rail, as well as the blind slats and bottom rail, in this embodiment of the invention the harder metallic strips 48 will extend only over a median portion of the length of the head rail 30, as shown in phantom in FIG. 4.

The features of the plastic head rail 30 are the same as those in FIGS. 2 and 3, and have the same reference numbers.

However, as explained above the metal reinforcement strips 48 will be shorter than the length of the head rail 30, in this embodiment, so as to permit trimming at each end, and will terminate short of each end of the head rail 30.

Figure 5:
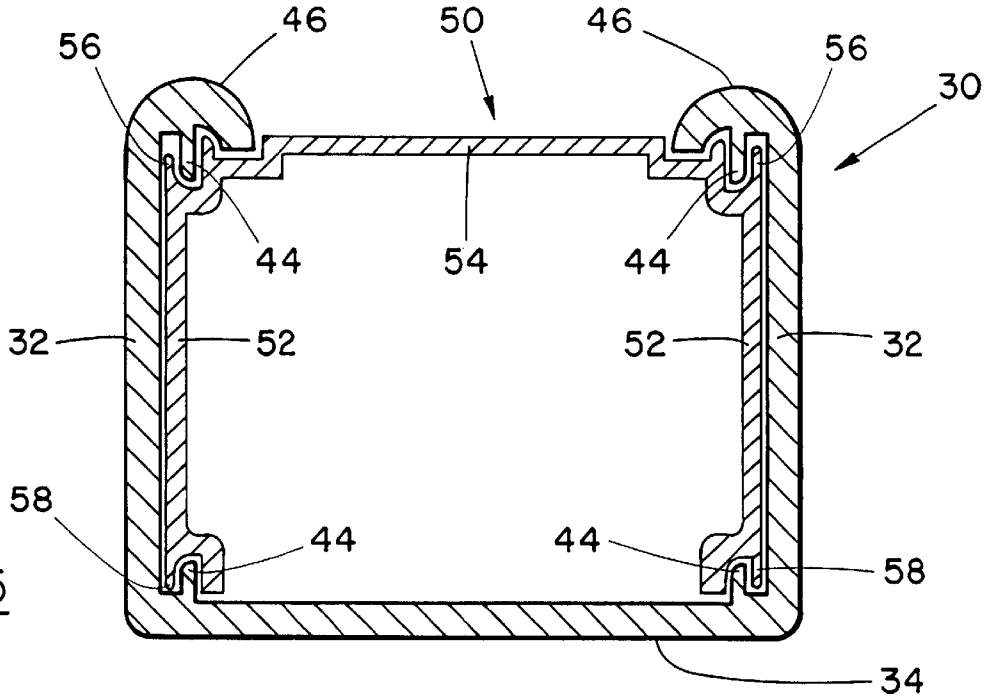
FIG. 5 is a section along line 5—5 of FIG. 4.
Figure 6:
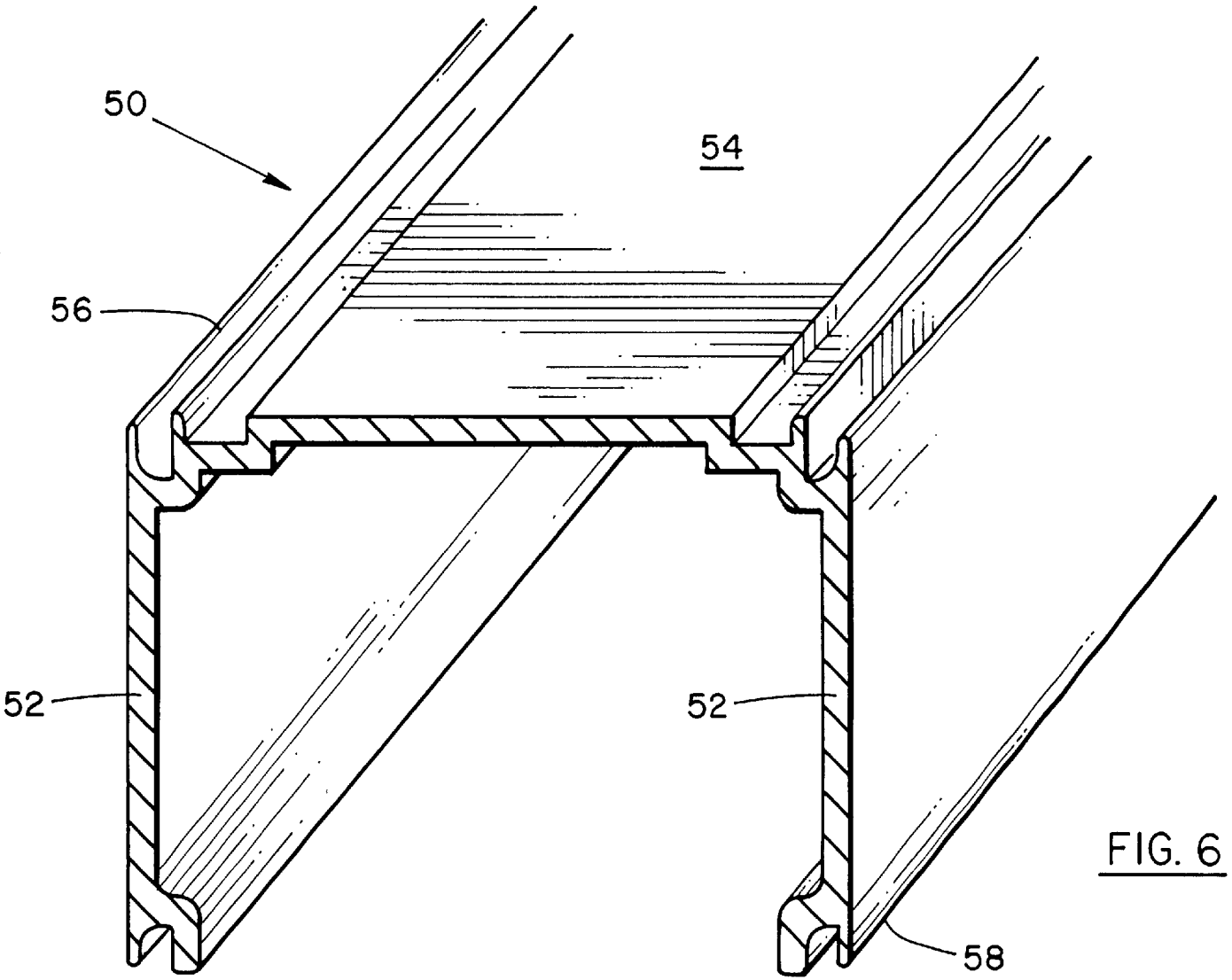
FIG. 6 is a perspective of a portion of FIG. 4.

In this case, additional stiffness at each end of head rail 30 is provided in this embodiment by stiffening plugs 50 (FIGS. 5 and 6).

Stiffening plugs 50 are formed of plastic material, and in this case may be in the shape of an inverted channel, although any other shape providing extra strength and stiffness will be suitable.

Side walls 52 and web 54, are integral, and define a width and height such that they make a sliding fit into the ends of head rail 32. To hold plug 50 secure, upper and lower lips 56 and 58 are arranged to interfit with ridges 44 on head rail 32. When slid into place at each end of head rail 32 the plugs 50 add stiffness to the ends of the head rail and at the same time permit trimming of the head rail, in these ends regions, by a variety of different cutting media, of which the saw cutter is one example, at the same time as trimming the blind slats and bottom rail.

Figure 7:
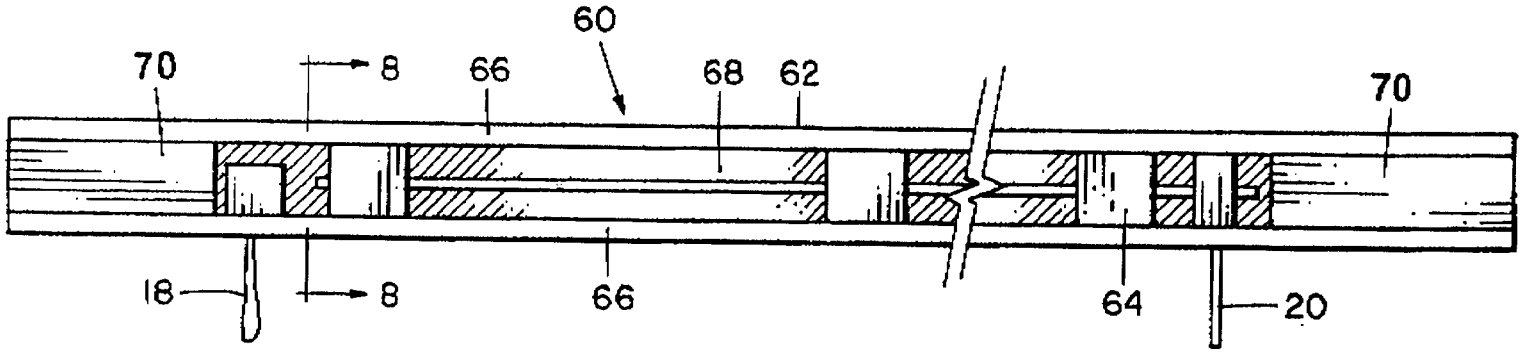
FIG. 7 is a top plan view of another embodiment of head rail.
Figure 8:
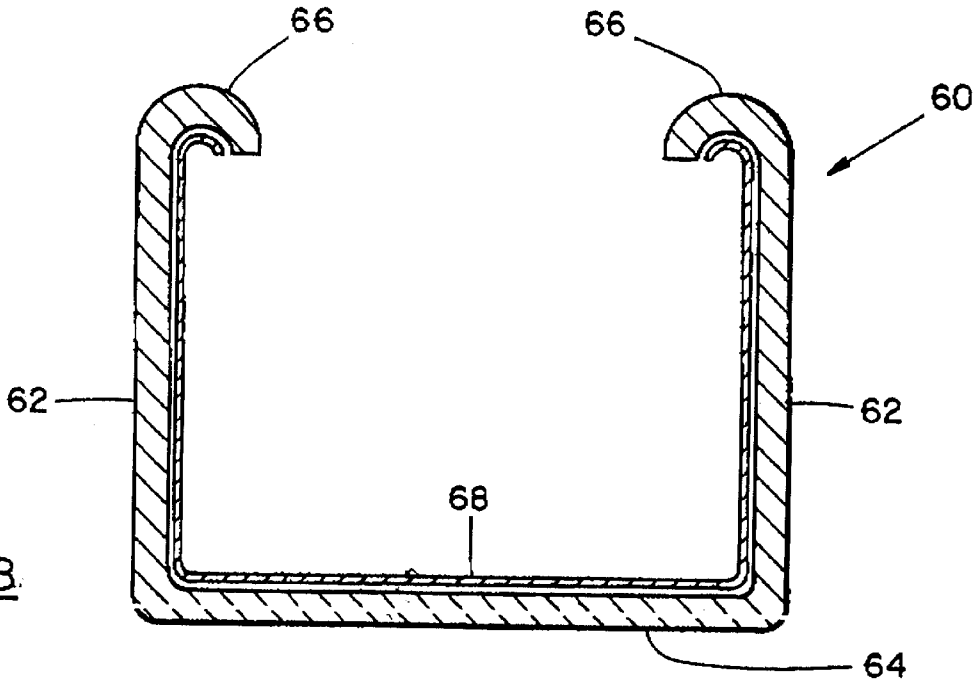
FIG. 8 is a section along line 8—8 of FIG. 7.

Another embodiment of reinforcement is shown in head rail 60 in FIGS. 7 and 8.

In this case the head rail 60 is of substantially regular channel-shaped cross-section, having side walls 62 and a web 64. Rolled edges 66 are formed on the upper free edges of side walls 62. The entire head rail 60, in some cases, or as in this illustration, only a median portion of head rail 60, is reinforced with a metallic three sided channel 68. Channel 68 is dimensioned to make a snug sliding fit within head rail 60. However, as in the FIG. 4 embodiment the reinforcement terminates short of each end of the head rail so as to leave portions at each end of the head rail, which are not reinforced, and are therefor suitable for trimming. Plugs 70, generally similar to plugs 50, will be inserted in each end of head rail 60, where the reinforcement member is absent, so as to permit trimming of each end by a saw. However, if the channel 68 was made of a softer metal, or a non-metal, then it could extend to full length of head rail 60, and in this case the plugs 70 would not be required.

Figure 9:
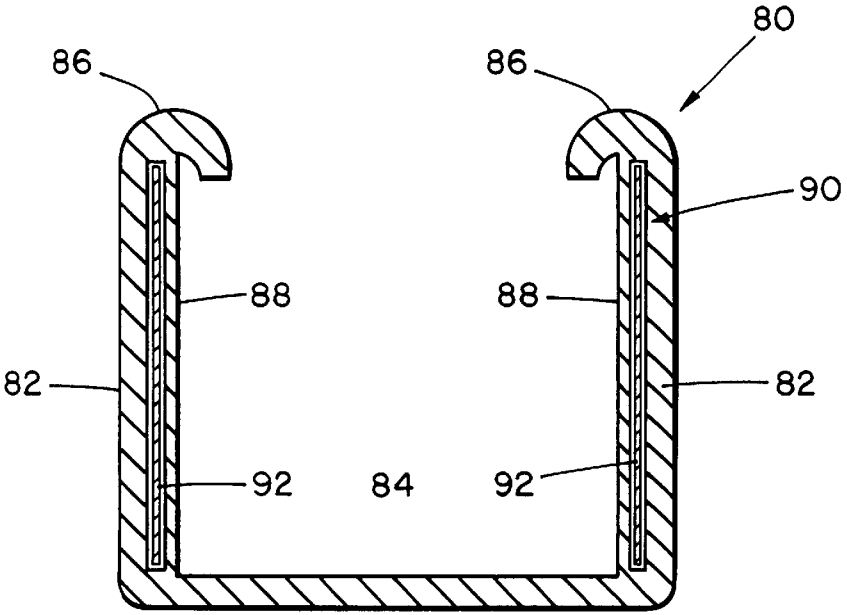
FIG. 9 is a section of a further form of head rail.

A further embodiment is shown in FIG. 9.

In this case, a head rail 80 is formed of extruded plastic material, having a shape in section generally similar to head rail 60, having side walls 82 and a web 84 defining a rectangular U-shaped channel, with rolled edges 86.

However, within side walls 82 there are formed inner passage walls 88 spaced inwardly from side walls 82, which define slim vertical passages 90.

Reinforcement strips 92 of suitable metallic reinforcement material are received in passages 90. In this way the reinforcement strips 92 can be held in position and resist bending stresses imposed on the head rail 80 by the weight of the blind slats. As before the metallic reinforcement, strips may be of softer metal, in which case they can extend the full length of head rail 80, or they may be of harder metal, in which case they would terminate short of each end. In this case some form of additional stiffness (not shown), such as plugs 50 or 70, would be inserted at the ends of the head rail.

Figure 10:
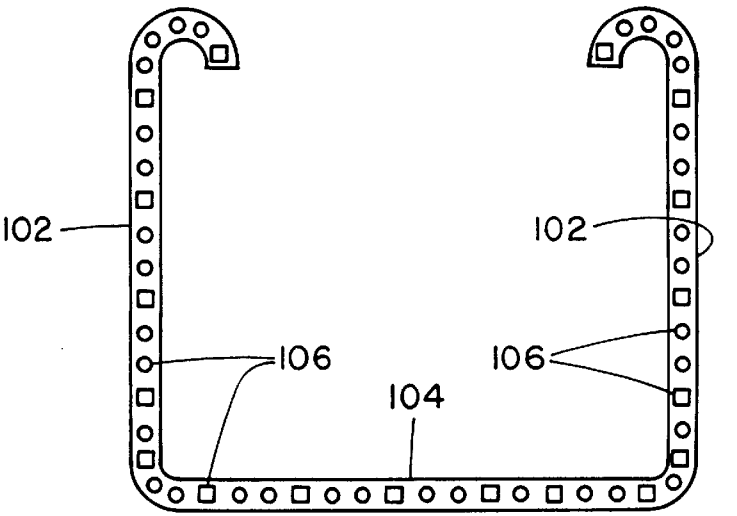
FIG. 10 is a section of a still further form of head rail.

A further embodiment is shown in FIG. 10.

In this case, a head rail 100, has side walls 102 and a web 104, formed of plastic material, and define a rectangular U-shaped channel. In this embodiment reinforcement is provided by a plurality of reinforcement strips or rods 106. Rods 106 would be co-extruded with the plastic material, and would be integrally embedded in the side walls and web as illustrated. The rods could be made of any suitable metal, or of non-metallic material adequate to provide reinforcement for the head rail 100.

In this case, provided the reinforcement material is suitable, the rods could be continued to the ends of the head rail 100. There would then be no need for a plastic plug at each end. The ends could simply be trimmed with a saw, which would cut both the plastic material and the reinforcement rods 106.

Figure 11:
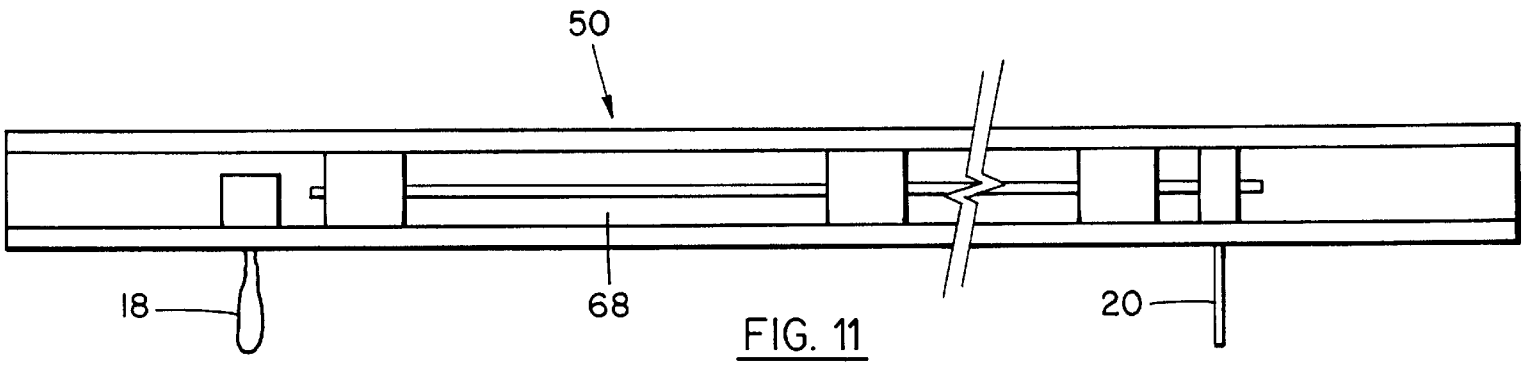
FIG. 11 is a plan view of another form of head rail.

For the sake of completeness, an embodiment of the invention having a metallic reinforcement channel 68 extending from end to end of the head rail is illustrated in FIG. 11.

It will be understood that with suitable selection of reinforcement materials, especially softer metals, or non-metals, any of the embodiments of FIGS. 1 to 9 could all be made with reinforcement extending from end to end, as shown in FIG. 11, provided that the reinforcements were suitable for cutting, by what ever cutting system was available in the store.

Figure 12:
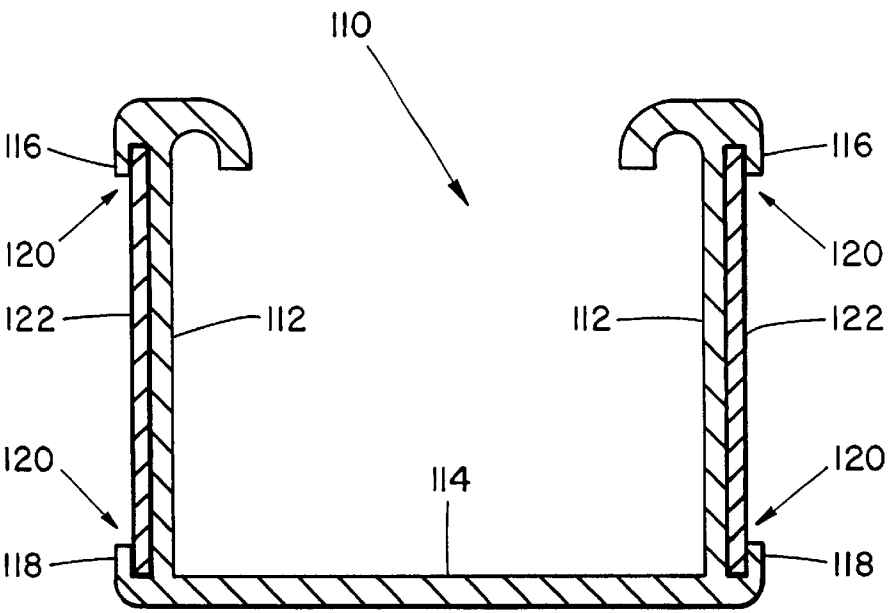
FIG. 12 is a section of a further alternate form of head rail.

A still further embodiment is shown in FIG. 12. In this case the head rail 110 is extruded from thermoplastic material, with side walls 112 and a bottom wall 114.

On the outer sides or side walls 112 upper and lower retaining lips 116 and 118 are formed, defining retention grooves 120. Exterior reinforcement strips 122 are slid into grooves 120, to provide extra bending resistance to the head rail 110.

Strips 122 may be of non-metallic materials, or of metals, either of which being softer, and suitable for cutting in an end trimming apparatus. In this embodiment such reinforcement strips 122 will preferably extend the full length of head rail 110 since the reinforcement strip on at least one side of the head rail 110 will be visible at all times and will in fact present the finished exterior appearance of the head rail 110. In this embodiment this factor may well be an advantage. The exterior facing or finish of the head rail 110 will be the appearance of the reinforcement strip 122.

Since this can be made in a variety of finishes and materials and colours, this embodiment offers great flexibility for stores and for customers.

In all the examples described above, the head rail has been described as a three sided channel. This is in fact the commonest form of such head rail, and is in wide use, both in metal structures as well as in extruded plastics. However it will be understood, that in certain cases, where the head rail is supported with a suitable reinforcement it may be possible to dispense altogether with one of the two channel side walls, of the extruded plastic channel. Thus the plastic head rail would become in effect an L-shaped extrusion with a front wall and a bottom wall, but with no back wall.

Figure 13:
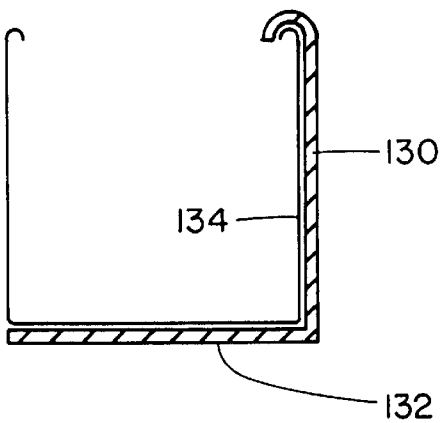
FIG. 13 is a section of a further alternate embodiment of head rail.

Such an embodiment is shown in FIG. 13. The head rail extrusion consists of front wall 130 and bottom wall 132, formed of extruded plastic material.

A reinforcement channel 134 is secured within walls 130 and 132. It may be of softer metal or non metal and extend from end to end, or it may be formed of steel in which case it will terminate short of each end. In this cases some further end members such as plugs 52 of FIGS. 2 and 3 can be used at each end, so as to permit trimming of each end in store end trim machines.

This may not be suitable for every form of blind, and may not be acceptable to all customers. However for those customers looking for economy and low price, it might have a certain appeal.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An extruded plastic head rail for a blind having a plurality of blind elements suspended from a head rail, said head rail being reinforced to prevent sagging of said head rail under the load of said plurality of blind elements, and being suitable for trimming to length by an in store point of sale trim cutting apparatus, said head rail comprising:

(a) a head rail extrusion extruded from plastic material for forming said head rail and defining at least a front wall and a bottom wall, said head rail being of a predetermined length; and (b) a reinforcement member in said head rail, said reinforcement member being the same length as said head rail, wherein said reinforcement member is formed of a material adapted to be cut by the in store point of sale trim cutting apparatus, said reinforcement member being adapted to support said head rail and said plurality of blind elements, and to prevent bending of said head rail under the load of said plurality of blind elements.

2. An extruded plastic head rail for a blind as claimed in claim 1 wherein said head rail defines a front side wall and a rear side wall and a bottom wall.

3. An extruded plastic head rail for a blind as claimed in claim 2 wherein said reinforcement member comprises a three sided channel of reinforcement material.

4. An extruded plastic head rail for a blind as claimed in claim 3 wherein said reinforcement material is metallic.

5. An extruded plastic head rail for a blind as claimed in claim 1 wherein said head rail is of generally L-shape in section and defines a front wall and a bottom wall, and wherein said reinforcement member is a generally three sided channel fitting within said front wall and said bottom wall.

6. An extruded plastic head rail for a blind as claimed in claim 2 wherein said head rail is formed with upper retention flanges in said side walls, and wherein said reinforcement member is received in said flanges.

7. An extruded plastic head rail for a blind as claimed in claim 6 wherein said head rail further defines lower retention flanges on said side walls, and wherein said reinforcement member is in the form of two planar reinforcement strips, each said strip being received in respective upper and lower flanges.

8. An extruded plastic head rail for a blind as claimed in claim 7 wherein said retention flanges are located on the inwardly facing sides of said side walls.

9. An extruded plastic head rail for a blind as claimed in claim 7 wherein said retention flanges are formed on the outwardly facing sides of said side walls.

10. An extruded plastic head rail for a blind having a plurality of blind elements suspended from a head rail, said head rail being reinforced to prevent sagging of said head rail under the load of said plurality of blind elements, and being suitable for trimming to length by a point of sale trim cutting apparatus, said head rail comprising:

(a) a head rail extrusion extruded from plastic material for forming said head rail and defining at least a front wall, a side wall and a bottom wall;

(b) a reinforcement member in said head rail, said reinforcement member extending along at least a median portion of said head rail, said reinforcement member being adapted to support said head rail and said plurality of blind elements and to prevent bending of said head rail under the load of said plurality of blind elements, said reinforcement member having at least one planar strip of metallic material;

(c) said head rail being formed with at least one partition wall along said side wall, defining at least one elongated passage therein; and wherein at least one metallic strip being received within said at least one passage.

11. An extruded plastic head rail for a blind as claimed in claim 10, wherein said reinforcement member is shorter than said head rail and terminates short of each end of said head rail.

12. An extruded plastic head rail for a blind as claimed in claim 11 and including reinforcement plug members located in each end of said head rail and wherein said plug members are formed of a material softer than said reinforcement member whereby said head rail may be cut at each end in the region of said plug members.

13. An extruded plastic head rail for a blind as claimed in claim 4, wherein said head rail is formed with two partition walls along said side wall defining two elongated passages therein, and wherein each of said passages receive a metallic strip therein.

14. An extruded plastic head rail for a blind as claimed in claim 10, wherein said reinforcement member is the same length as said head rail and extends from end to end thereof, and wherein said reinforcement member is formed of a material adapted to be cut by the point of sale trim cutting apparatus.

15. An extruded plastic head rail for a blind as claimed in claim 10, wherein said reinforcement member has at least one rigid strip of plastic material.

16. An extruded plastic head rail for a blind as claimed in claim 15, wherein said plastic material is received within at least one elongated passages.

17. An extruded plastic head rail for a blind having a plurality of blind elements suspended from a head rail, said head rail being reinforced to prevent sagging of said head rail under the load of said plurality of blind elements and being suitable for trimming to length by a point of sale trim cutting apparatus, said head rail comprising:

(a) a head rail extrusion extruded from plastic material for forming said head rail and defining at least a front wall and a bottom wall;

(b) a reinforcement member in said head rail, said reinforcement member extending along at least a median portion of said head rail, said reinforcement member being adapted to support said head rail and said plurality of blind elements, and to prevent bending of said head rail under the load of said plurality of blind elements; and (c) said reinforcement member having a plurality of reinforcement rods embedded in said head rail.

18. An extruded plastic head rail for a blind as claimed in claim 17, wherein said reinforcement member is the same length as said head rail and extends from end to end of said head rail, and wherein said reinforcement member is formed of a material adapted to be cut by a point of sale trimming apparatus.

19. An extruded plastic head rail for a blind having a plurality of blind elements suspended from a head rail, said head rail being reinforced to prevent sagging of said head rail under the load of said plurality of blind elements, and being suitable for trimming to a reduced length at a point of sale establishment by a trim apparatus, said head rail comprising:

(a) a head rail extrusion extruded from plastic material for forming said head rail and defining at least one side wall and a bottom wall, said head rail having two ends spaced at a predetermined length;

(b) said head rail being formed with at least one partition wall along at least one said side wall defining at least one elongated passage therein;

(c) a reinforcement member in said head rail having at least one planar strip of metallic material, wherein said strip is received within said at least one passage of said head rail;

(d) said reinforcement member being of a length shorter than said predetermined length of said head rail and extending along a median portion of said head rail and terminating short of said ends of said head rail; and (e) plug members located in each end of said head rail in which said reinforcement member is absent, wherein said plug members are formed of a material softer than said reinforcement member, whereby said head rail may be cut at each end in the region of said plug members.

20. An extruded plastic head rail for a blind having a plurality of blind elements suspended from a head rail, said head rail being reinforced to prevent sagging of said head rail under the load of said plurality of blind elements, and being suitable for trimming to a reduced length at a point of sale establishment by a trim cutting apparatus, said head rail comprising:

(a) a head rail extrusion extruded from plastic material for forming said head rail and defining at least a front wall, a bottom wall, and two ends separated by a predetermined length;

(b) a reinforcement member of a material stiffer than said head rail and located in said head rail, said reinforcement member being the same length as said head rail and extending from end to end of said head rail, for supporting said head rail and said plurality of blind elements, and to prevent bending of said head rail under the load of said plurality of blind elements; and (c) said reinforcement member being formed of a material having characteristics adapting it to be trimmed by the trim cutting apparatus.

* * * * *